United States Patent [19]

Dietzel et al.

[11] 3,960,083

[45] June 1, 1976

[54] IGNITER CONTAINING TITANIUM HYDRIDE AND POTASSIUM PERCHLORATE

[75] Inventors: Russel W. Dietzel; William B. Leslie, both of Albuquerque, N. Mex.

[73] Assignee: The United States of America as represented by the United States Energy Research & Development Administration, Washington, D.C.

[22] Filed: Mar. 6, 1975

[21] Appl. No.: 555,754

[52] U.S. Cl. ..... 102/28 R; 149/77

[51] Int. Cl.[2] ..... F42B 3/18; F42C 19/12; C06B 29/02

[58] Field of Search ..... 102/28 EB, 28 R; 149/77

[56] References Cited

UNITED STATES PATENTS

| | | | |
|---|---|---|---|
| 3,203,843 | 8/1965 | Jackson | 149/19.3 |
| 3,227,083 | 1/1966 | Moses et al. | 102/28 R |
| 3,309,250 | 3/1967 | Falterman et al. | 149/42 |
| 3,336,452 | 8/1967 | Baker | 102/28 R |
| 3,620,166 | 11/1971 | Bratton et al. | 102/28 R |
| 3,814,694 | 6/1974 | Klager et al. | 252/186 |
| 3,840,324 | 10/1974 | Shaffer et al. | 149/29 X |
| 3,906,858 | 9/1975 | Craig et al. | 102/28 R |

OTHER PUBLICATIONS

Jacobson et al., Chem. Abs., 61, abs. No. 13117h (1964).

*Primary Examiner*—Edward A. Miller
*Attorney, Agent, or Firm*—Dean E. Carlson; Dudley W. King; Ignacio Resendez

[57] ABSTRACT

An explosive device is described which employs a particular titanium hydride-potassium perchlorate composition directly ignitible by an electrical bridgewire.

5 Claims, 3 Drawing Figures

IGNITER CONTAINING TITANIUM HYDRIDE AND POTASSIUM PERCHLORATE

BACKGROUND OF INVENTION

The invention relates to explosive devices, e.g., actuators, squibs, and detonators, to actuate a valve, drive a piston to rupture a conduit or to impact against an explosive to effect detonation or the like, etc.

Prior art explosive devices which are activated by electrical bridge-wires generally require a separate initiation material sensitive enough to be initiated by the electrical bridgewire, which initiation material then ignites and additional output charge material. Generally the initiation materials are less stable, more sensitive primary explosives and the output charge materials are more stable, less sensitive secondary explosives. These initiating materials present safety disadvantages in that they are generally spark sensitive and may be ignited by lightning strokes, accidental shock, and the like. For example, static electricity generated on the body of a person working on or with the device may accidentally set off those devices which use these initiating explosives. As such, extreme care and caution must be employed in handling these materials, not only from the standpoint of accidentally setting them off when placed in position for detonation, but also from the standpoint that the initiator material may accidentally ignite during fabrication of actuators, squibs or the like.

There are some materials that are directly ignitible by an electrical bridgewire, such as titanium-potassium perchlorate (Ti-$KClO_4$) which is generally considered to be spark insensitive in a compacted or pressed condition, but which as a powder is spark sensitive. Therefore, devices employing that material may be erroneously believed to be static insensitive but may have deteriorated in use to a static sensitive condition by vibration, aging, and the like.

It would be preferred not to employ a spark or static sensitive material or a material which may become spark or static sensitive in or for squibs, actuators, or the like, or in their fabrication, because of the safety hazard of ignition from static electricity.

Although prior actuators, squibs and the like have been designed to be non-static sensitive by the incorporation of bleeder resistors, spark gaps, insulating sleeves, etc., these are not deemed completely safe as long as they are constructed of, or employ, explosive materials that are static sensitive. The above techniques are subject to manufacturing variables and unless all the materials of the device are static insensitive, the device will not be deemed completely safe from the static sensitivity standpoint.

SUMMARY OF INVENTION

In view of the above, it is an object of this invention to provide an explosive device such as an actuator, squib or detonator which is not objectionably static electricity sensitive or spark sensitive.

It is a further object of this invention to provide a high-temperature stable explosive device which employs a particular titanium hydride-potassium perchlorate ($TiH_2$-$KClO_4$) composition ignitible by an electrical bridgewire.

It is a further object of this invention to provide an actuator which employs the $TiH_2$-$KClO_4$ composition as the sole explosive charge, which composition has an autoignition temperature of not less than about 520°C.

It is a further object of this invention to provide an explosive device which is relatively inert to lightning strokes and also to accidental impact.

It is a further object of this invention to provide an actuator or the like which employs an electrical bridgewire ignitible explosive material or charge that is a secondary explosive both as a loose powder and as a compacted pellet.

It is a further object of this invention to provide an explosive device that is thermally stable up to about 520°C. and is not ignited when a 600 picofarad (pf) capacitor charged to 25 kilovolts is discharged from the bridgewire to the case of the device in the absence of series resistors.

Various other objects and advantages will become apparent from the following description of this invention and the most novel features will be pointed out with particularity hereinafter in connection with the appended claims. It is understood that various changes in the details, materials and process steps which are herein described and illustrated to better explain the nature of the invention may be made by those skilled in the art without departing from the scope of this invention.

As shown the invention comprises, in brief, an explosive device having a housing with a cavity therein, a pair of spaced electrical conductors extending from the exterior of the housing into the cavity, an electrical bridgewire in the cavity electrically connected to the electrical conductors, means for electrically insulating the electrical bridgewire and the conductors from the housing, an explosive charge disposed in the cavity against or in direct contact with the bridgewire, the explosive charge being from about 26 to about 33 weight percent titanium hydride ($TiH_2$) blended with from about 74 to about 67 weight percent potassium perchlorate ($KClO_4$), the $TiH_2$ and the $KClO_4$ having a particle size of not greater than about 3 microns and preferably less than about one micron.

DETAILED DESCRIPTION

Figure 1:
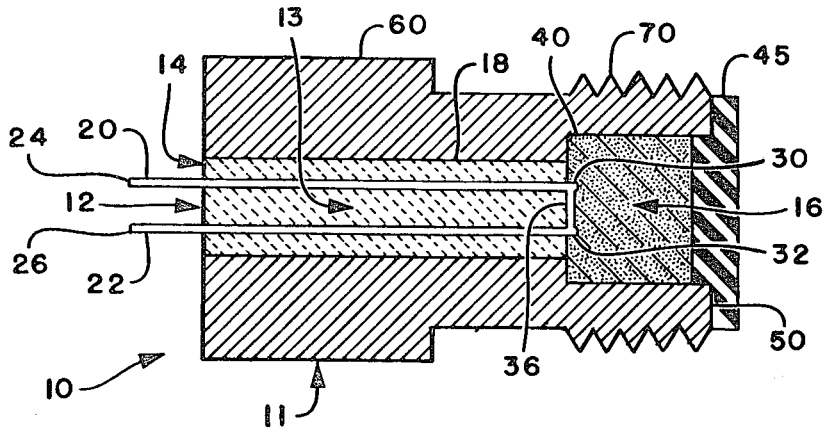
FIG. 1 illustrates in cross-sectional view an embodiment of this invention.

As shown in FIG. 1, an explosive device 10 of this invention, such as an actuator, has a housing 11 having a passageway or opening 12 therethrough, with the latter divided into a narrow portion 13 of one diameter and an enlarged diameter portion which forms a recess or cavity 16.

Housing 11 may be made of any suitable material such as aluminum, steel, 303 series stainless steel, and the like. Disposed within the narrow portion 13 of passageway 12, is a header 14 or plug of a suitable electrically insulative material 18 having disposed therethrough a pair of electrical conductors 20, 22. Electrically insulative material 18 may be any suitable material such as a borosilicate glass or a ceramic material such as aluminum oxide, or any suitable plastic material. Electrical conductors 20, 22 may be made of materials that are good electrical conductors such as nickel-iron alloys or nickel-iron-cobalt alloys.

End portions 24, 26 of electrical conductors 20, 22 may project from the electrically insulative material 18 to serve as terminal pins for electrical connection to a source of electricity (not shown). End portions 30, 32 of electrical conductors 20, 22 may project into recess or cavity 16 from electrically insulative material 18 for electrical connection with electrical bridgewire 36 by resistance welding, brazing, or otherwise as appropriate. Electrical bridgewire may be made of any suitable material such as an alloy having a composition of about 74.5 weight percent nickel, about 20 weight percent chromium, about 2.75 weight percent copper and about 2.75 weight percent aluminum.

Explosive charge 40 is placed or disposed in recess or cavity 16 against or in direct contact with electrical bridgewire 36. Although an electrical bridgewire is herein referred to, it is understood that other igniting elements, such as a carbon element, may be used to ignite the $TiH_2$-$KClO_4$ charge mixture. Recess 16 may be closed or sealed by using appropriate closure cap or seal 45, which may be an elastomeric material over explosive charge 40 in recess 16 which may overlap end portion 50 of housing 10 to protect the explosive charge from moisture or the like. Elastomeric material may be any suitable elastomer such as silicone rubber. In the alternative, it may be desirable to dispose a metal seal or disc over explosive charge 40 and end portion 50 of housing 11 to effect a seal and retain explosive charge 40 within recess 16. The metal seal or disc may be appropriately joined to the housing such as by welding or the like.

Figure 2:
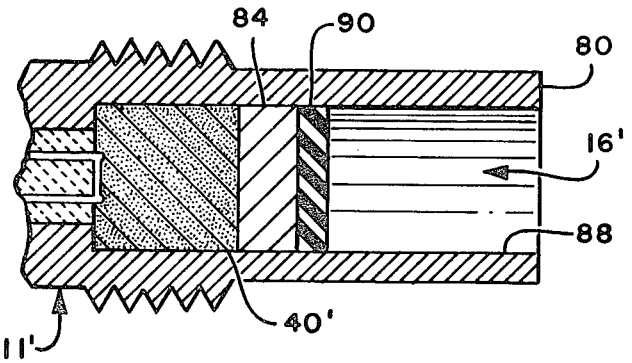
FIG. 2 illustrates in a cutaway, cross-sectional view an alternate embodiment of this invention.

FIG. 2 illustrates a portion of an alternate embodiment wherein housing 11 includes an elongated tubular portion 80. Disposed in cavity 16' adjacent the $TiH_2$-$KClO_4$ composition or charge 40' recited herein, may be a piston or other movable member 84 made of such as brass, aluminum or steel, and which is disposed in bore or cylindrical wall 88 in a tight fit. After charge 40 is ignited, gas pressure builds up behind piston 84 until a predetermined yield point pressure is reached at which time piston 84 is impelled through the remaining portion of cavity 16' to open or close conduits, operate electrical contacts, strike and detonate another explosive charge, or the like. It may be desirable to retain an elastomeric or the like cover member 90 to prevent moisture or other materials from coming into contact with explosive charge 40'.

Explosive charge 40 is formed of a mixture of from about 26 to about 33 weight percent $TiH_2$ and from about 74 to about 67 weight percent $KClO_4$. The mixture has a particle size of no greater than 3 microns, and preferably less than about one micron. $TiH_2$ and $KClO_4$ may be blended using accepted known procedures for blending explosive powders. The explosive charge produced by blending or intermixing is, in effect, a secondary explosive both as a loose powder and as a pellet. The amount of explosive charge disposed in the cavity 16 (16') will be dependent upon the function to be performed and the work output required. It may be desirable to dispose the $TiH_2$-$KClO_4$ composition within the cavity and thereafter to compress the powder at a pressure of from about 300 to about 1000 kilograms per square centimeter ($Kg/cm^2$) to arrive at a compressed form which is in intimate contact with the electrical bridgewire. The explosive device such as an actuator described herein provides reliable and reproducible results using an electrical bridgewire to ignite a $TiH_2$-$KClO_4$ mixture wherein the particles of the components of the mixture are all less than or equal to 3 microns. One may if desired dispose a first $TiH_2$-$KClO_4$ mixture having a particle size of 3 microns or less adjacent and in direct contact with the bridgewire, for initiation purposes, and a second $TiH_2$-$KClO_4$ mixture having a larger particle size such as below about 10 microns. Other materials such as pentaerythritol tetranitrate (PETN) may comprise the second mixture.

The equation which is believed to express the reaction which occurs between $TiH_2$ and $KClO_4$ upon actuation is:

$$4TiH_2 + 3KClO_4 \rightarrow 4TiO_2 + 4H_2O + 3KCl$$

The ranges recited herein for the $TiH_2$-$KClO_4$ mixture contain an excess of $KClO_4$ over the stoichiometric requirement since best results have been obtained using this excess. In addition, although titanium hydride is represented herein as having the formula $TiH_2$, other titanium-hydrogen ratios may be employed, such as from $TiH_{1.5}$ to $TiH_2$. $KClO_4$ is the preferred reactant but other materials such as $NaClO_4$ or the like may also be employed if consideration is given to the drawbacks of other materials such as hygroscopicity.

Various tests were conducted to compare the properties of Ti-$KClO_4$ pyrotechnic powder with those of $TiH_2$-$KClO_4$ pyrotechnic powder. Ti-$KClO_4$ is a known pyrotechnic powder which has good properties but which has been found to act as an undesirable primary explosive as a loose powder. These pyrotechnic powders were prepared by mixing the two components of each pyrotechnic in 20 gram batches by blending the two components on a sheet of paper using a plastic spatula in a static-free area. The bulk density of the pyrotechnic powders was determined by filling a small container of known volume with powder. The bulk density for Ti-$KClO_4$ was found to be 0.67 grams per cubic centimeter (g/cc) and for $TiH_2$-$KClO_4$ was found to be 0.81 g/cc.

The impact height for these two pyrotechnic powders as well as for PETN was determined by standard two kilogram weight drop test using a 20 milligram (mg) sample for each determination. The anvil and cup were bare steel. The impact threshold was determined as that height at which one initiation was obtained in ten samples tested. Impact threshold values were 114 centimeters for Ti-$KClO_4$ powder, 114 centimeters for $TiH_2$-$KClO_4$ powder, and 35 centimeters for PETN. $TiH_2$-$KClO_4$ thus has an impact threshold value comparable to Ti-$KClO_4$ but much superior to the PETN value.

Figure 3:
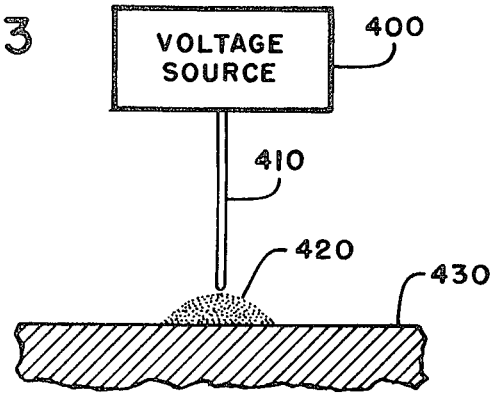
FIG. 3 illustrates the test arrangement used for determining spark ignition threshold properties.

Spark ignition threshold properties for loose pyrotechnic powders were measured in a test setup as shown in FIG. 3 by applying a voltage from a voltage source 400 such as by discharging a 600 pf capacitor from an electrode 410 through a sample of loose powder 420, which was approximately a 200 mg sample, to a ground plane 430. The distance between the powder and the electrode was maintained at about one mm. No resistance was added to the discharge path. Only one discharge was made through each sample. The voltage was varied until one ignition in ten samples tested was obtained or the limits of the test equipment was reached. Energy stored in the capacitor at that voltage level was designated as the spark ignition threshold. In summary, it was found that the ignition threshold for $Ti\text{-}KClO_4$ powder was less than 7.5 millijoules (mJ) and for $TiH_2\text{-}KClO_4$ was greater than 480 mJ. The spark ignition threshold value of $TiH_2\text{-}KClO_4$ is seen to be substantially superior to that of $Ti\text{-}KClO_4$ and as such an explosive device employing $TiH_2\text{-}KClO_4$ directly ignitible by an electrical bridgewire would be very much preferred because of greater static and spark insensitivity.

Using the teachings of this invention explosive devices such as actuators have been formed by machining the housing from such as 303 series stainless steel hexagonal bar stock. In FIG. 1 housing 11 may have an end portion 60 of hexagonal shape, a threaded portion 70 for mating with the component which is to be actuated or otherwise acted upon, as well as a tubular portion (FIG. 2) which encloses or houses a piston or other actuating member 84. The header 14 may be made from a suitable glass, such as borosilicate glass, and the electrically conductive members 20, 22 may be made of such materials as nickel and its alloys or clad materials such as copper-nickel and the like, and are preferably made of materials that are good electrical conductors such as nickel-iron and nickel-iron-cobalt alloys. Electrically insulative material 18 may likewise be of any suitable ceramic material such as alumina which contains at least 94.0 weight percent aluminum oxide. The end portions 30, 32 of electrical conductors 20, 22 which project into recess 16 may be spaced about 2.41 mm center to center. Electrical bridgewire 36 may be about 0.051 mm diameter, the wire being an alloy of composition of about 74.5 weight percent nickel, about 20 weight percent chromium, about 2.75 weight percent copper, and about 2.75 weight percent aluminum. This particular alloy may have a resistance of about 800 ohms per circular mil foot, a temperature co-efficient of $\pm 3 \times 10^{-6}$, and may exhibit high resistance to corrosion as well as high tensile strength. The electrical bridgewire 36 may be resistance welded to the end portions 30, 32 of electrical conductors 20, 22. The bridgewire length is 1.40 mm and the resistance is $1.00 \pm 0.10$ ohm.

Header 14 with bridgewire 36 may be pressed into the actuator housing 11. The explosive charge may be placed in recess 16 either as a pellet or a powder may be disposed within recess 16 and pressed against the bridgewire at from about 300 to about 1,000 $Kg/cm^2$, such as about 703 $Kg/cm^2$, to partially fill the cavity, the latter method being preferred because of the maximum contact of explosive material and bridgewire resulting therefrom.

In the following comparison of $Ti\text{-}KClO_4$ and $TiH_2\text{-}KClO_4$, 175 mg of $Ti\text{-}KClO_4$ were used versus 110 mg of $TiH_2\text{-}KClO_4$ in recesses 16. Some of the devices fired by bridgewire ignition were assembled using an about 7.95 mm diameter pressed brass disc which was about 0.41 mm thick retained against the powder for confinement. FIG. 1 illustrates confining means 45 such as a cap which may be appropriately engaged with end portion 50 of housing 11. It is to be understood that the geometery of retaining means will be dependent upon the function to be performed by device or actuator 10. In general, the bulk density of the powder in the explosive devices such as actuators in the following tests was 1.93 g/cc for $Ti\text{-}KClO_4$ and 2.23 g/cc for $TiH_2\text{-}KClO_4$.

Spark initiation threshold values of the explosive device for $Ti\text{-}KClO_4$ loaded devices as compared with $TiH_2\text{-}KClO_4$ loaded devices was measured by discharging a charged 600 pf capacitor from the bridgewire to the body or housing. In one test series, the capacitor was charged to 20 kilovolts and then discharged through the housing with a 500 ohm resistor placed in the discharge circuit. There were no ignitions recorded in this series. In a separate test series, which is a more severe test, the capacitor was charged to a specific voltage and then discharged through the housing with no resistance added to the discharge circuit; the voltage was varied until one initiation was obtained in ten units tested at one voltage level, or until ten units were tested at the maximum voltage of the tester. The energy stored in the capacitor at that voltage level was designated as the spark initiation threshold. This value was determined to be greater than 370 mJ for $Ti\text{-}KClO_4$ composition and 270 mJ for $TiH_2\text{-}KClO_4$ composition. This data indicates that explosive devices such as actuators having the $TiH_2\text{-}KClO_4$ charge composition recited herein will not be initiated by a discharge from the human body.

Spark initiation tests were made for $TiH_2\text{-}KClO_4$ loaded devices with an actuator that contained two bridgewires connected in series. The inside diameter of the actuator cavity was 5.0 mm and contained about 162 mg of $TiH_2\text{-}KClO_4$ pressed at about 703 $kg/cm^2$. The internal arc path from bridgewire to case was 1.0 mm. A 600 pf capacitor was charged to 35 kilovolts and discharged through the actuator, from pins to case, with a 500 ohm resistor in the discharge circuit. A layer of oil, approximately 3 mm deep, covered the top of the actuator to prevent external arcing from leads to case. There were no initiations in 10 units tested. This additional data further substantiates the above finding that explosive devices having the $TiH_2\text{-}KClO_4$ charge composition recited herein will not be initiated by a discharge from the human body.

The autoignition (self-ignition) temperature of the device was determined by disposing it in an assembly to which a thermocouple and recorder were used to monitor the internal temperature of the assembly. The assembly was heated at a rate of 13.9°C. per minute by controlling the rate at which it was lowered into a preheated furnace. When the autoignition temperature was reached, the recorder showed a strong exotherm caused by ignition of the powder. The autoignition temperature of the device containing the $Ti\text{-}KClO_4$ charge was 475°C. and for the device containing the $TiH_2\text{-}KClO_4$ was 520°C. Thus $TiH_2\text{-}KClO_4$ loaded explosive devices have an additional margin of safety (45°C.) over $Ti\text{-}KClO_4$ loaded explosive devices which are generally recognized as having a high autoignition temperature. This additional margin is especially critical where the system using the explosive device is intended to function at elevated temperatures, or where it is desired that the explosive device not function prior to the system being rendered inoperable in such as an accidental fire situation.

No-fire tests were conducted by assembling a device into test assemblies and passing a one ampere DC current through the bridgewire for a 5 minute period both at ambient temperature and again at 74°C. Devices loaded with $Ti\text{-}KClO_4$ or $TiH_2\text{-}KClO_4$ did not fire in either of the tests. The minimum current for ignition was determined by passing a constant current through the bridgewire and determining if the powder ignited within a fraction of a second, the current level being lowered until the minimum level was reached. The lowest current level that produced ignitions in four out of five units tested was 1.7 amperes (2.9 watts) for Ti-$KClO_4$ loaded devices and 1.3 amperes (1.7 watts) for $TiH_2$-$KClO_4$ loaded actuators. These values exceed the one ampere — one watt no-fire test commonly used in the industry to qualify explosive devices such as actuators, squibs, detonators or the like.

The time required to burn out or melt the bridgewire in a loaded device was determined by passing a 3.5 ampere constant DC current through the wire. The elapsed time from the start of current flow to a sudden decrease in current value was read from a photograph of the oscilloscope trace. Average values were, for Ti-$KClO_4$ loaded actuators, 2.8 milliseconds and for $TiH_2$-$KClO_4$ loaded actuators, 4.2 milliseconds illustrating that initiation occurs within a desirable short time.

One approach to the study of the accelerated aging of a pyrotechnic powder is to hold the powder at elevated temperatures and then test for signs of degradation. Loaded explosive devices were assembled into test assemblies and thereafter heated in a temperature test chamber at 100°C.±1°C. for 30 days. The assemblies were then fired at ambient temperature using 3.5 ampere direct current source. Devices containing Ti-$KClO_4$ or $TiH_2$-$KClO_4$ fired properly and yielded a satisfactory output. Powder removed from devices containing $TiH_2$-$KClO_4$ was tested for spark sensitivity as loose powder. The threshold for ignition was found to be greater than 480 mJ. Thus the accelerated aging test proved that the $TiH_2$-$KClO_4$ composition retained its spark insensitivity characteristics.

Explosive devices made in accordance with this description are very insensitive to initiation by static electricity, have a very high autoignition temperature, are easily loaded into a pressing die and can be pressed smooth without binding or galling the pressing fixture, are stable at temperatures above ambient, and finally, are not initiated by static electricity from the human body.

What is claimed is:

1. An explosive device thermally safe against initiation at temperatures up to about 520°C. comprising a housing having a cavity therein, a pair of electrical conductors extending from the exterior of said housing into said cavity, a bridgewire in said cavity electrically connected with said conductors, an explosive charge in said cavity in close contact with said bridgewire consisting essentially of a mixture of from about 26 weight percent to about 33 weight percent titanium hydride particles blended with from about 74 weight percent to about 67 weight percent potassium perchlorate particles, said titanium hydride particles and potassium perchlorate particles being of size not greater than about 3 microns, with said explosive charge being directly ignitible by said bridgewire.

2. The device of claim 1 wherein said titanium hydride particles and said potassium perchlorate particles are of size not greater than about 1 micron.

3. The device of claim 1 including a piston member in said cavity to be propelled by the reaction of said explosive charge.

4. The device of claim 1 wherein said housing has a passageway therein communicating with said cavity, said conductors penetrate said passageway, and said passageway is closed by an electrically insulative plug which encircles each of said conductors.

5. The device of claim 1 wherein said titanium hydride and potassium perchlorate particles are of about 1 micron size and said device is not ignited when a 600 picofarad capacitor at 25 kilovolts is discharged between housing and bridgewire, said device being spark and static electricity insensitive.

* * * * *